US008042464B2

(12) United States Patent
Gertsch et al.

(10) Patent No.: US 8,042,464 B2
(45) Date of Patent: Oct. 25, 2011

(54) ROTARY PRESS

(75) Inventors: Peter Gertsch, Niederscherli (CH); Robert Imhof, Bern (CH)

(73) Assignee: Gimaco Ingenieur AG fuer Maschinenbau, Bern (CH)

( * ) Notice: Subject to any disclaimer, the term of this patent is extended or adjusted under 35 U.S.C. 154(b) by 515 days.

(21) Appl. No.: 12/067,124

(22) PCT Filed: Sep. 25, 2006

(86) PCT No.: PCT/EP2006/066682

§ 371 (c)(1),
(2), (4) Date: Mar. 17, 2008

(87) PCT Pub. No.: WO2007/036502

PCT Pub. Date: Apr. 5, 2007

(65) Prior Publication Data

US 2008/0257181 A1 Oct. 23, 2008

(30) Foreign Application Priority Data

Sep. 30, 2005 (EP) ..... 05109125

(51) Int. Cl.

| | |
|---|---|
| ***B41F 5/04*** | (2006.01) |
| ***B41F 13/02*** | (2006.01) |
| ***B41F 5/16*** | (2006.01) |
| ***B41F 5/18*** | (2006.01) |
| ***B41F 31/00*** | (2006.01) |

(52) U.S. Cl. ..... 101/221; 101/180; 101/335

(58) Field of Classification Search ..... 101/335, 101/348, 349.1, 179, 180, 181, 220, 221
See application file for complete search history.

(56) References Cited

U.S. PATENT DOCUMENTS

| | | | | |
|---|---|---|---|---|
| 946,808 | A * | 1/1910 | Pringle | 101/220 |
| 1,034,348 | A * | 7/1912 | Gompf | 48/87 |
| 4,621,575 | A * | 11/1986 | Jeschke | 101/217 |
| 5,718,172 | A | 2/1998 | Ruckmann et al. | |
| 5,816,157 | A | 10/1998 | Gertsch et al. | |
| 7,156,018 | B2 * | 1/2007 | Holm et al. | 101/218 |
| 2002/0185025 | A1 | 12/2002 | Dufour et al. | |

FOREIGN PATENT DOCUMENTS

| | | |
|---|---|---|
| WO | 2005 037553 | 4/2005 |

* cited by examiner

*Primary Examiner* — Judy Nguyen
*Assistant Examiner* — Leo T Hinze
(74) *Attorney, Agent, or Firm* — Oblon, Spivak, McClelland, Maier & Neustadt, L.L.P.

(57) ABSTRACT

A rotary press including a plurality of printing groups each with a plate cylinder and a blanket cylinder arranged in the machine frame such that respectively two blanket cylinders are configured to be leaned against each other and, in this way, a paper web that is guidable between the blanket cylinders is printable on both sides. Furthermore, the press includes inking units for inking the printing groups and damping units for applying a damping medium. The inking units are configured such that, with at least some of the inking units, two plate cylinders and thus two blanket cylinders at a time are able to be inked up. In this way, a compact, space-saving and economical design of the press is achieved.

13 Claims, 4 Drawing Sheets

ROTARY PRESS

Figure 1:
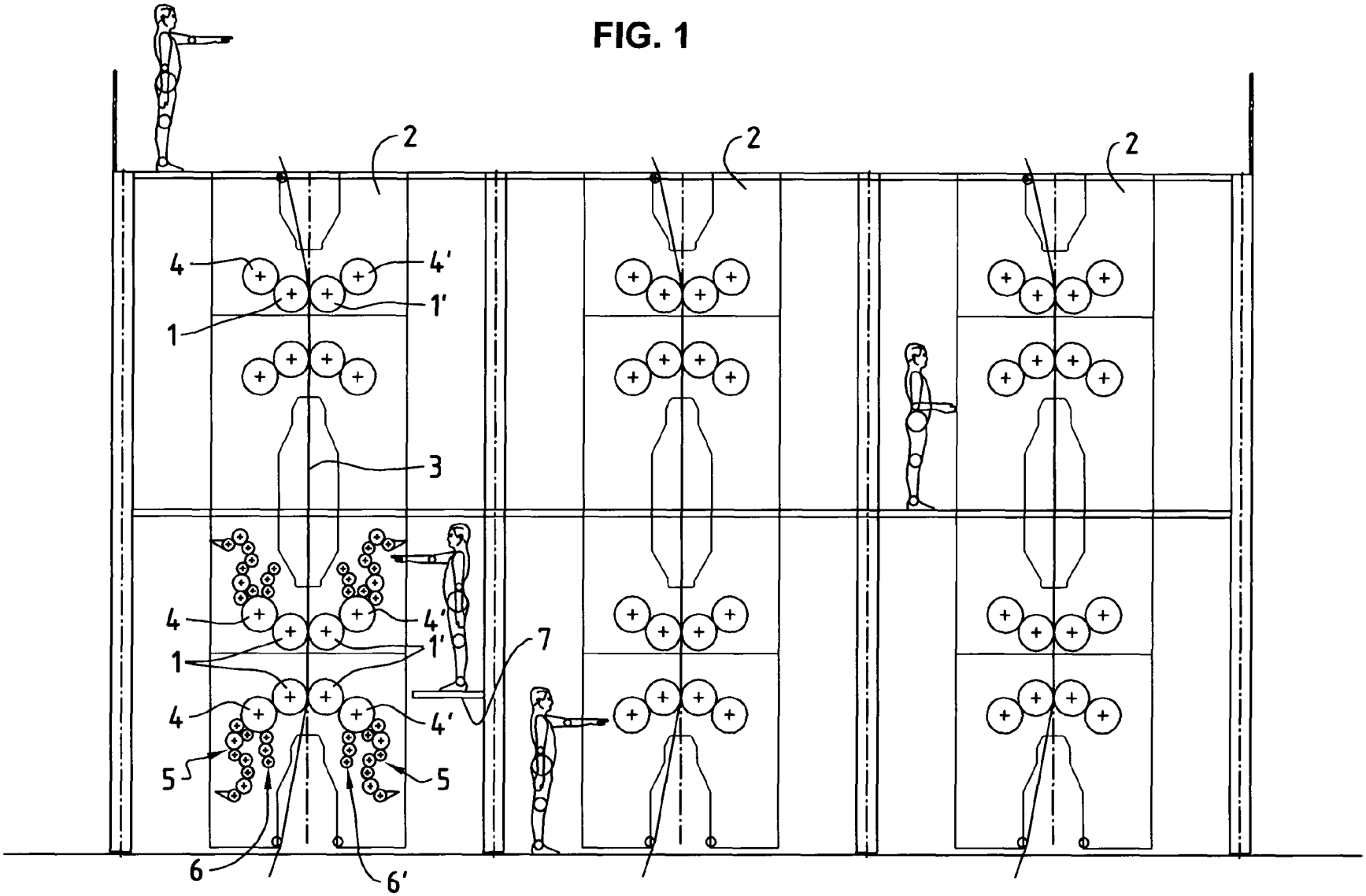

The present invention relates to a rotary press, comprising a plurality of printing groups, each with a plate cylinder and a blanket cylinder, which are disposed in machine frames in such a way that in each case two blanket cylinders are able to be leaned against each other, and, in this way, a web of paper, which is guidable between the blanket cylinders, is printable on both sides, inking units for inking up the printing groups and, if applicable, damping units for applying the damping medium.

Such printing machines are known. In particular in newspaper and magazine production, the two-sided, four-color printing of the webs of paper to be printed has become the standard. Shown in the attached FIG. 1 and described in the following is a printing machine belonging to the state of the art and with which this two-sided, four-color printing can be carried out.

With the known printing machines, the blanket cylinders 1, 1', able to be leaned against one another, are centrally disposed in the machine frames 2. Configured here in the form of a tower are four printing group pairs in each case; the web of paper 3 to be printed passes through these printing group pairs centrally inside the machine frames 2, and is thereby four-color-printed on both sides. Assigned to each blanket cylinder 1, 1' is a plate cylinder 4, 4'. Each plate cylinder 4, 4' is inked in each case via an inking unit 5, and is moistened via a damping unit 6.

Shown in this FIG. 1 are three adjacently disposed printing towers that are identically equipped. Access to the printing groups and in particular to the blanket cylinders 1, 1' and the plate cylinders 4, 4' takes place from the outer side of the machine frame 2. Provided for this purpose are so-called printer lifts or printer elevators 7, which make it possible for the operating person to be lifted or respectively lowered to the respective working height.

Furthermore printing machines of this kind are increasingly automated. In particular automatic installations are used for the washing of rollers and blanket cylinders. Also used are automatic devices for the exposure of the plates of the plate cylinder, the plates being inserted in the plate cylinder. Devices for automatic lifting in of the plates and for automatic paper feed are also used. The majority of these devices for automation must be employed in the area of the plate and blanket cylinders. Since, in this known embodiment example, the blanket cylinders are disposed substantially centrally in the machine frame, the amount of space available for automatic devices of this kind is very limited. Moreover accessibility is thereby impeded in these areas for an operating person.

The object of the present invention thus consists in creating a rotary press which is characterized by a compact and thus space-saving construction, and which is able to be produced economically.

This object is achieved according to the invention in that the inking units are designed such that, with at least some of the inking units, two plate cylinders, and thus two blanket cylinders, are able to be inked up at a time.

Obtained with this configuration is a rotary press that has a considerably smaller overall height and a considerably shorter length, compared with known printing machines. Through this compact construction, the space requirement for such a rotary press is also considerably less. Costs can also be saved through the more compact construction as well as through the smaller space requirement.

An advantageous embodiment of the invention consists in that the inking units are centrally disposed in the machine frame, and each blanket cylinder protrudes beyond the respective machine frame side, and is able to be leaned on the corresponding blanket cylinder and taken off this cylinder, which corresponding blanket cylinder is disposed in the adjacent machine frame.

With these aforementioned configurations, the accessibility to the blanket cylinders and the plate cylinders is considerably simplified. Moreover space is created for the automating devices since both plate cylinders and blanket cylinders are disposed in each case on the machine frame side. Furthermore huge savings can be made with respect to the inking units since the inking units are each able to ink two plate cylinders at a time.

Preferably each blanket cylinder is borne in the one end regions of two pivoting levers, which pivoting levers are pivotable with their other end regions about the axis of the plate cylinder. The blanket cylinders can thereby be pivoted away out of the printing area in a simple manner, and thus leave space free for the operating person.

A simple construction for the pivoting of the two pivoting levers is achieved in that this takes place via linear drives, the one ends of which are coupled to the machine frame, while the other ends are coupled to the pivoting levers.

A further advantageous embodiment of the invention consists in that the blanket cylinders in the pivoted back position are able to be brought into working connection with a blanket washing unit. This blanket washing unit can be disposed in an optimal way in the machine frame, without accessibility to the printing groups being thereby affected.

Also the plate exposure installations, which are able to be assigned in each case to the plate cylinders, are able to be disposed in such a way that they practically do not affect the accessibility to the respective cylinders and rollers for an operating person.

Preferably, via guide rollers, the paper webs are guidable between the blanket cylinders, the guide rollers being disposed in a displaceable way. On the one hand, the paper web feed is very simple since it can be provided for between the adjacent machine frames. On the other hand, through the displacement of the guide rollers, the paper web can be shifted in each case such that the printing groups not covered by the paper web are optimally accessible to the operating person.

A further advantageous embodiment of the invention consists in that ink transfer rollers are able to be put on each other and taken off each other. The two printing groups, which are served by one inking unit, can be switched on and off, with respect to inking, whereby a great flexibility is achievable.

When the blanket cylinders disposed between the machine frames are taken off each other, platforms for the operating person can be placed in this area. These placed platforms are movable in height; the operating person thus obtains optimal access to the different printing groups.

An embodiment of the present invention will be explained more closely in the following, by way of example, with reference to the attached drawing.

Figure 2:
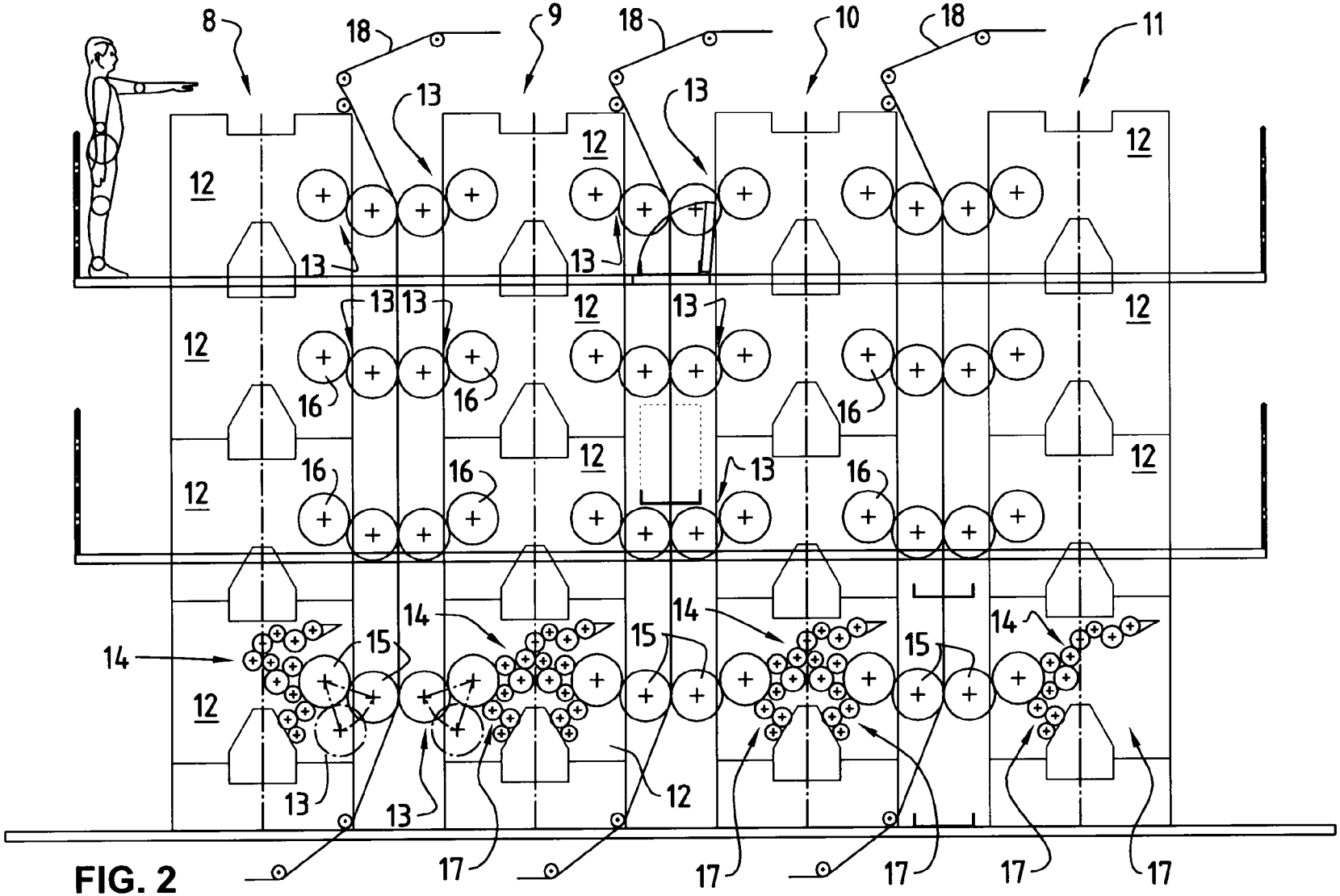
Figure 3:
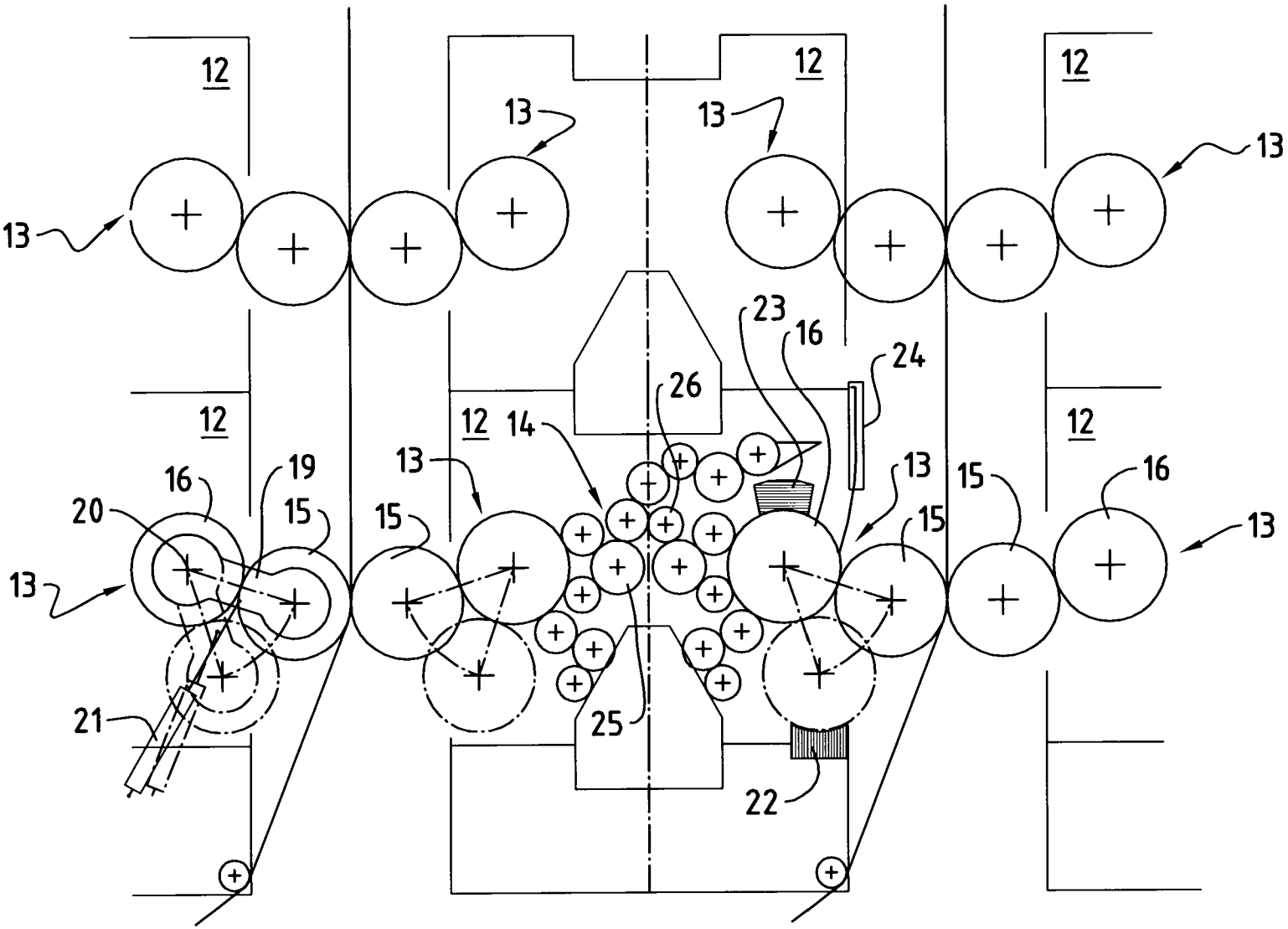
Figure 4:
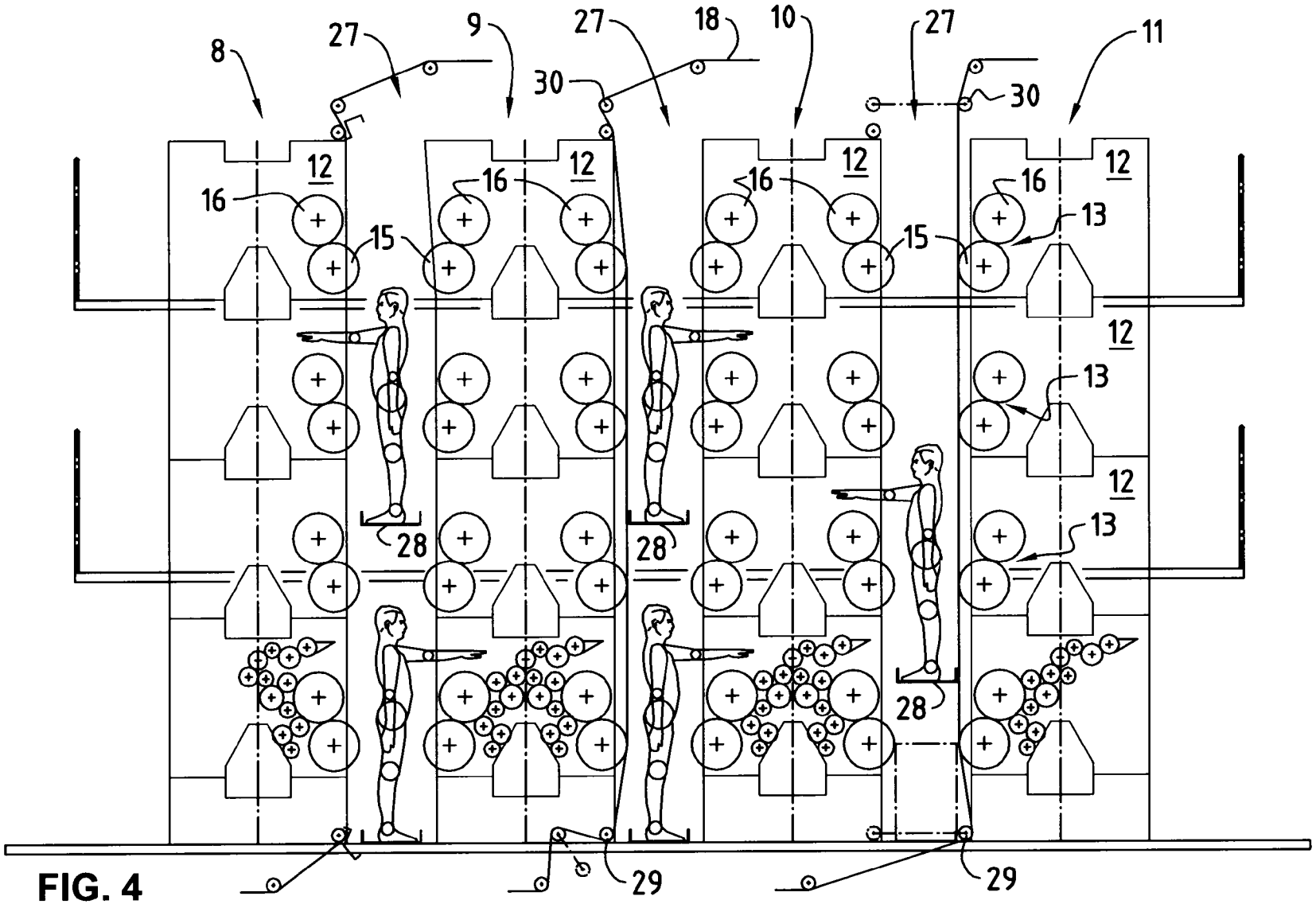

Shown are:

FIG. 1, a diagrammatic view of a printing machine belonging to the state of the art, which has already been described in the foregoing;

FIG. 2, a diagrammatic side view of the rotary press according to the invention during the printing process;

FIG. 3, in a diagrammatic representation, a detailed view of printing groups of the rotary press according to the invention; and FIG. 4, a diagrammatic view of the rotary press according to the invention, in which the blanket cylinders are taken off each other, and space is thus created for the operating persons.

As can be seen from FIG. 2, the rotary press shown here is made up of four printing towers 8, 9, 10, 11. Each printing tower 8, 9, 10, 11 is composed of four machine frames 12 placed on top of one another. Each machine frame 12 of the printing tower 8, disposed on the left side, bears a printing group 13. The machine frames 12 of the printing towers 9 and 10 each bear two printing groups 13, while each machine frame 12 of the printing tower 11, disposed on the right side, bears once again only one printing group 13. Disposed centrally in each machine frame 12 is an inking unit 14. For the sake of clarity, these inking units 14 in FIG. 2 are each shown only in the lowermost machine frame 12 of the printing towers 8, 9, 10, 11. Each of these inking units 14 is composed, in a known way, of an ink chamber, transfer rollers and application rollers. The inking units 14 of the printing groups 13 which are accommodated in the two middle printing towers 9 and 10 are each designed such that one inking unit 14 is provided for every two printing groups 13. In the case of the printing tower 8, on the left side, and the printing tower 11, on the right side, only one printing group 13 is provided per machine frame 12, so that their inking units 14 have to ink up only one printing group 13.

As can be seen from this FIG. 2, the inking units 14 are disposed centrally in the machine frames 12. The blanket cylinders 15 of each printing group 13 protrude in each case, edge-side, beyond the respective side of the machine frame 12. Also the plate cylinders 16 are disposed in each case on the side edge of the machine frame 12, and co-operate in a known way with the corresponding blanket cylinder 15. Provided in addition for each plate cylinder 16 is a damping unit 17, which serves the application of the moistening medium on the plate cylinder 16. Of course with rotary presses that use the well known offset method without damping units, the installation of damping units can be omitted.

Of course it is also conceivable for damping units to be used which, corresponding to the inking units, moisten two printing groups at a time jointly.

In the state shown in FIG. 2, the rotary press is in printing position. This means that the blanket cylinders 15 are placed together, and that the paper web 18 is guided through between the blanket cylinders 15 in each case. In this state, the printing groups of the printing tower 8 co-operate with the printing groups 13, disposed on the left side, of the printing tower 9, the right-side printing groups 13 of the printing tower 9 co-operate with the left-side printing groups 13 of the printing tower 10, etc. This means that the paper webs 18 each run through between two printing towers 8 and 9, or respectively 9 and 10, or respectively 10 and 11. Through this configuration of the printing groups 13, with the inking units 14 accommodated centrally in the machine frames 12, the printing groups lie very close together, compared with known machines, such as the one described in the foregoing, whereby, in addition to the simpler construction of the printing machine, a relatively large saving of space can be achieved.

Shown in FIG. 3 is an enlarged representation of the lowermost printing groups 13 of a middle printing tower 9 or 10 according to FIG. 2. It can be seen in FIG. 3 on the left side that the blanket cylinder 15 is rotatably borne in the one end region of pivoting levers 19, disposed on both sides, which pivoting levers 19 are pivotable with their other end regions about the axis 20 of the respective plate cylinder 16. The pivoting of these pivoting levers 19 takes place via linear drives 21, whose one ends are coupled to the machine frame 12, while the other ends are coupled to the pivoting levers 19. With this design, each blanket cylinder 15 is able to be brought from the printing position, as is shown in FIG. 3 with unbroken lines, into a pivoted-back position, which is shown in FIG. 3 with dots and dashes.

In the pivoted-back state of the blanket cylinders 15, these cylinders arrive in working connection with a blanket washing unit 22, of which only one is shown in FIG. 3. Of course a corresponding washing unit is provided for each blanket cylinder 15 of the entire printing machine.

Furthermore an automatic plate exposure device 23 is assigned to each plate cylinder 16 of this printing machine. With this plate exposure device 23, new plates put on the plate cylinder 16 are able to be exposed in a known way directly in the printing machine.

Furthermore an automatic plate insertion device 24 is assigned to each plate cylinder 16. The plates can thereby be inserted automatically onto the plate cylinder 16.

As can be seen from this FIG. 3, with the configuration presented here, there is enough space available for these additional automating devices because the inking unit 14 is disposed centrally in the machine frame 12, and the respective printing groups are installed laterally thereto.

In a known way, ink transfer rollers are able to be taken off and put on each other. This can be, for example, the inking unit roller 25 and the inking unit roller 26; when, for instance, the inking unit roller 25 is taken off, the printing group 13 disposed in FIG. 3 on the left side of the inking unit is not inked, while in the taken-off state of the ink transfer roller 26, the printing group 13 shown in FIG. 3 on the right side of the inking unit 14 is not inked. Thus printing groups can be switched on or switched off, as needed, depending upon which printing order must be carried out. A great degree of flexibility is thereby obtained as well.

In a known way, the supplied quantity of ink is regulated zone-wise, also with these inking units 14. If two printing groups must be inked via the one inking unit 14, the required quantity of ink for both printing groups is added together per zone. This can be achieved through a corresponding programming of the ink zone control.

In FIG. 4 the same printing machine is shown as in FIG. 2. In the state shown in FIG. 4, however, all blanket cylinders 15 are brought into the in pivoted-back position. In the taken-off state of these blanket cylinders 15 an interim space 27 is obtained in each case between the individual printing towers 8, 9, 10, 11. So-called printer lifts or elevators 28 can be put in this interim space 27, with which lifts or elevators the operating person can be brought to the respective height for servicing the various devices. In FIG. 4, in the interim space 27 between the printing towers 8 and 9, the paper web 18 has been taken out. This means that the respective person can carry out the necessary manipulations on both sides. After conclusion of these tasks, the paper web can be automatically threaded again in a known way.

In the interim space 27 between the printing towers 9 and 10, the paper web 18 has not been taken out; it is thus positioned against the blanket cylinders 15 that are disposed in the right-side printing groups 13 of the printing tower 9. A printer lift or elevator 28 is then able to be used here too; only the side of the printing tower 10 is then accessible for the operating person since the opposite side of the printing tower 9 is covered by the paper web 18. Shown in the interim space 27 between the printing towers 10 and 11, in FIG. 4, is that the paper web 18 can also be driven on the other side; for this purpose the two guide rollers 29 and 30, over which the paper web is guided in each case through the printing machine, are drivable from the one side, which is illustrated in FIG. 4 with dots and dashes, to the other side, position shown with unbroken line. The other side of the respective interim space 27 is thereby unblocked.

In order to further improve accessibility, the respective interim space 27 between the printing towers 8, 9, 10, 11 can be enlarged in that the printing towers 8, 9, 10, 11 are designed displaceable in a known way. In the taken-off state of the blanket cylinders 15, as is shown in FIG. 4, it would thus be possible to shift, for example, the printing tower 9 toward the printing tower 8, whereby the interim space 27 between the printing tower 9 and the printing tower 10 would be enlarged. Of course, in the printing position, the printing towers 8, 9, 10, 11 would have to be able to be positioned precisely and locked.

Obtained with this inventive configuration is a rotary press which can be built very compactly. In particular, compared with the state of the art, inking units can be saved since the inking units employed can ink up two printing groups each. In addition, spatial relations facilitating an optimal operation are created between the printing groups, it being also possible to accommodate in this space all the devices for automation. By means of this configuration and the simplified construction, costs can moreover be saved. The energy requirement is also smaller than with the known printing machines.

The invention claimed is:

1. A rotary press, comprising:

a plurality of printing groups, each including a plate cylinder and a blanket cylinder, which are disposed in a respective machine frame such that a first blanket cylinder of a first machine frame is configured to lean against a blanket cylinder of a horizontally adjacent second machine frame, and a vertical paper web that is guidable between the first blanket cylinder of the first machine frame and the blanket cylinder of the second machine frame is printable on both sides; and a plurality of inking units centrally disposed in the respective machine frame to ink the printing groups, wherein an inking unit of the first machine frame jointly inks the first blanket cylinder on a side of the first machine frame and a second blanket cylinder on an opposite side of the first machine frame.

2. The rotary press according to claim 1, wherein each blanket cylinder protrudes beyond a side of the respective machine frame, and the first blanket cylinder of the first machine frame is configured to be put on and taken off the blanket cylinder of the second machine frame.

3. The rotary press according to claim 1, wherein each blanket cylinder is of first end regions of two pivoting levers, which pivoting levers are pivotable with second end regions about the axis of the plate cylinder.

4. The rotary press according to claim 3, wherein the pivoting of the two pivoting levers takes place via linear drives, first ends of which are coupled to the machine frame, while second ends are coupled to the pivoting levers.

5. The rotary press according to claim 1, wherein the blanket cylinders in a pivoted-back position are configured to be brought into working connection with a blanket washing unit.

6. The rotary press according to claim 1, wherein a plate exposure device is assigned to the plate cylinders.

7. The rotary press according to claim 1, wherein the paper webs are guidable, via guide rollers, between the blanket cylinders, and the guide rollers are disposed in a displaceable way.

8. The rotary press according to claim 1, further comprising ink transfer rollers configured to be taken off each other and put on each other.

9. The rotary press according to claim 1, wherein, with the blanket cylinders taken off one another, platforms are placeable between the machine frames.

10. The rotary press according to claim 9, wherein the platforms placed between the machine frames, with blanket cylinders taken off one another, are movable in height.

11. The rotary press according to claim 1, further comprising:

a damping unit that applies a damping medium to one of the plurality of printing groups.

12. The rotary press according to claim 1, wherein the first blanket cylinder of the first machine frame jointly inked by the inking unit of the first machine frame prints on a first paper web, and wherein the second blanket cylinder of the first machine frame jointly inked by the inking unit of the first machine frame prints on a second paper web separate from the first paper web.

13. The rotary press according to claim 12, wherein the first paper web and the second paper web are parallel straight-path paper webs.

* * * * *